US007100554B2

(12) United States Patent
Hirowatari et al.

(10) Patent No.: US 7,100,554 B2
(45) Date of Patent: Sep. 5, 2006

(54) CONTROLLER FOR CONTROLLING VALVE OPERATING CHARACTERISTIC IN AN INTERNAL COMBUSTION ENGINE

(75) Inventors: Seiji Hirowatari, Toyota (JP); Masanao Idogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 146 days.

(21) Appl. No.: 10/984,805

(22) Filed: Nov. 10, 2004

(65) Prior Publication Data

US 2005/0098131 A1 May 12, 2005

(30) Foreign Application Priority Data

Nov. 12, 2003 (JP) ..... 2003-382840

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,330,870 B1 * 12/2001 Inoue et al. ..... 123/90.17

FOREIGN PATENT DOCUMENTS

| | | |
|---|---|---|
| JP | 04-063922 | 2/1992 |
| JP | 2000-227034 | 8/2000 |
| JP | 2001-055935 | 2/2001 |
| JP | 2003-041994 | 2/2003 |

* cited by examiner

*Primary Examiner*—Thomas Denion
*Assistant Examiner*—Zelalem Eshete
(74) *Attorney, Agent, or Firm*—Kenyon & Kenyon LLP

(57) ABSTRACT

A controller for controlling valve timing imbalance between cylinder groups of an engine. For each cylinder group, the controller has a variable mechanism for varying the valve timing. A lock mechanism locks the variable mechanism so as to maintain the valve timing of the cylinder group at a lock value. An ECU sets a valve timing target value based on the operating condition of the engine. The ECU and an oil control valve drive the variable mechanism. The ECU restricts the valve timing target value of at least one of the variable mechanisms of which operation is unlocked when the operation of at least one of the variable mechanisms is locked so that difference between the target value and the lock value decreases.

14 Claims, 7 Drawing Sheets

M101

| Coolant temperature te (℃) | 70 | 80 | 85 | 95 | 115 |
|---|---|---|---|---|---|
| Predetermined speed r1 (rpm) | 800 | 1200 | 1300 | 1500 | 1700 |

CONTROLLER FOR CONTROLLING VALVE OPERATING CHARACTERISTIC IN AN INTERNAL COMBUSTION ENGINE

BACKGROUND OF THE INVENTION

The present invention relates to a device for controlling engine valves, and more specifically relates to a controller for varying the valve operating characteristics of intake valves and exhaust valves of an internal combustion engine.

An example of a conventional controller for controlling the valve timing of engine valves is disclosed in Japanese Laid-Open Patent Publication No. 2001-55935. This controller is provided with a variable mechanism for varying the valve timing by changing the relative rotation phase of a camshaft, and a lock mechanism for locking the relative rotation of the camshaft when the relative rotation phase is at a predetermined lock phase. In this controller, the change in the relative rotation phase, that is, the varying of the valve timing, is possible by unlocking the relative rotation of the camshaft. This controller is further provided with a means for detecting the unlocking of the relative rotation of the camshaft. When the unlocking is detected by the detecting means, the controller provides feedback control of the relative rotation phase such that the relative rotation phase approaches a target relative rotation phase.

When such a valve timing controller is applied to an internal combustion engine having a plurality of cylinder groups as in the case of V-type engines, each cylinder group is generally provided with a separate variable mechanism and lock mechanism. In this structure, it is desirable that the relative rotation phases be equal in all variable mechanisms. This arrangement is used because when a difference occurs in the relative rotation phases among the variable mechanisms, a change in torque is generated due to the torque difference among the cylinder groups.

When an unlocking operation is not performed properly in one of the lock mechanisms, however, the relative phase rotation of the camshaft is not properly unlocked. The relative rotation phase is maintained in the lock phase in the variable mechanism corresponding to the lock mechanism which cannot unlock the relative rotation of the camshaft. The previously mentioned feedback control is performed in the other variable mechanism corresponding to the lock mechanisms which unlocks the relative rotation of the camshaft. That is, the relative rotation phase is only changed to the target rotation phase in the other variable mechanism. As a result, a difference in the relative rotation phases is generated between the variable mechanism that does not unlock the relative rotation and the variable mechanism that unlocks the relative rotation, and a change in torque is generated in conjunction with this condition.

SUMMARY OF THE INVENTION

The present invention provides a controller for preventing imbalances of the output characteristics among cylinder groups of an internal combustion engine caused by differences in valve operating characteristics among a plurality of cylinder groups.

One aspect of the present invention is a controller for controlling a valve operating characteristic of engine valves for a plurality of cylinder groups included in an internal combustion engine. The controller includes a plurality of variable mechanisms, each provided for an associated one of the cylinder groups, for varying the valve operating characteristic of the associated cylinder group. A plurality of lock mechanisms, each provided for an associated one of the variable mechanisms, lock operation of the associated variable mechanism to maintain the valve operating characteristic of the associated cylinder group at a lock value. A setting means sets a target value for the valve operating characteristic based on an operating condition of the engine. A drive means drives each of the variable mechanisms so that the valve operating characteristic approaches the target value. A determination means determines whether the operation of the variable mechanism associated with each lock mechanism is locked. A restriction means restricts the target value for the valve operating characteristic of at least one of the variable mechanisms of which operation is unlocked when the operation of at least one of the variable mechanisms is locked so that difference between the target value and the lock value decreases.

Another aspect of the present invention is a controller for controlling valve timing of engine valves for a plurality of cylinder groups included in an internal combustion engine. The controller includes a plurality of pulleys, each provided for an associated one of the cylinder groups. A plurality of shafts, each attached to an associated one of the pulleys, drive the associated engine valves. A plurality of variable mechanisms, each provided for an associated one of the cylinder groups, change a relative rotation phase between the pulley and the shaft to vary the valve timing. A plurality of lock mechanisms, each provided for an associated one of the variable mechanisms, lock operation of the associated variable mechanism so that the relative rotational phase between the pulley and the shaft is maintained at a lock phase. An electronic control unit sets a target phase for the relative rotational phase between the pulley and the shaft based on the operation conduction of the internal combustion engine, controls each variable mechanism so that the relative rotational phase between the pulley and the shaft approaches the target phase, determines whether operation of each variable mechanism associated with each lock mechanism is locked, and restricts the target value for at least one of the variable mechanisms of which operation is unlocked when the operation of at least one of the variable mechanisms is locked so that difference between the target value and the lock value decreases.

A further aspect of the present invention is a method for controlling valve timing of engine valves in a plurality of cylinder groups included in an internal combustion engine. The method includes setting a target value for the valve timing based on the operating condition of the internal combustion engine, varying the valve timing so that the valve timing approaches the target value, locking the valve timing at a lock value, determining whether the valve timing is locked, and restricting the target value for the valve timing in at least one of the variable mechanisms of which valve timing is unlocked when the valve timing of at least one of the variable mechanisms is locked so that difference between the target value and the lock value decreases.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
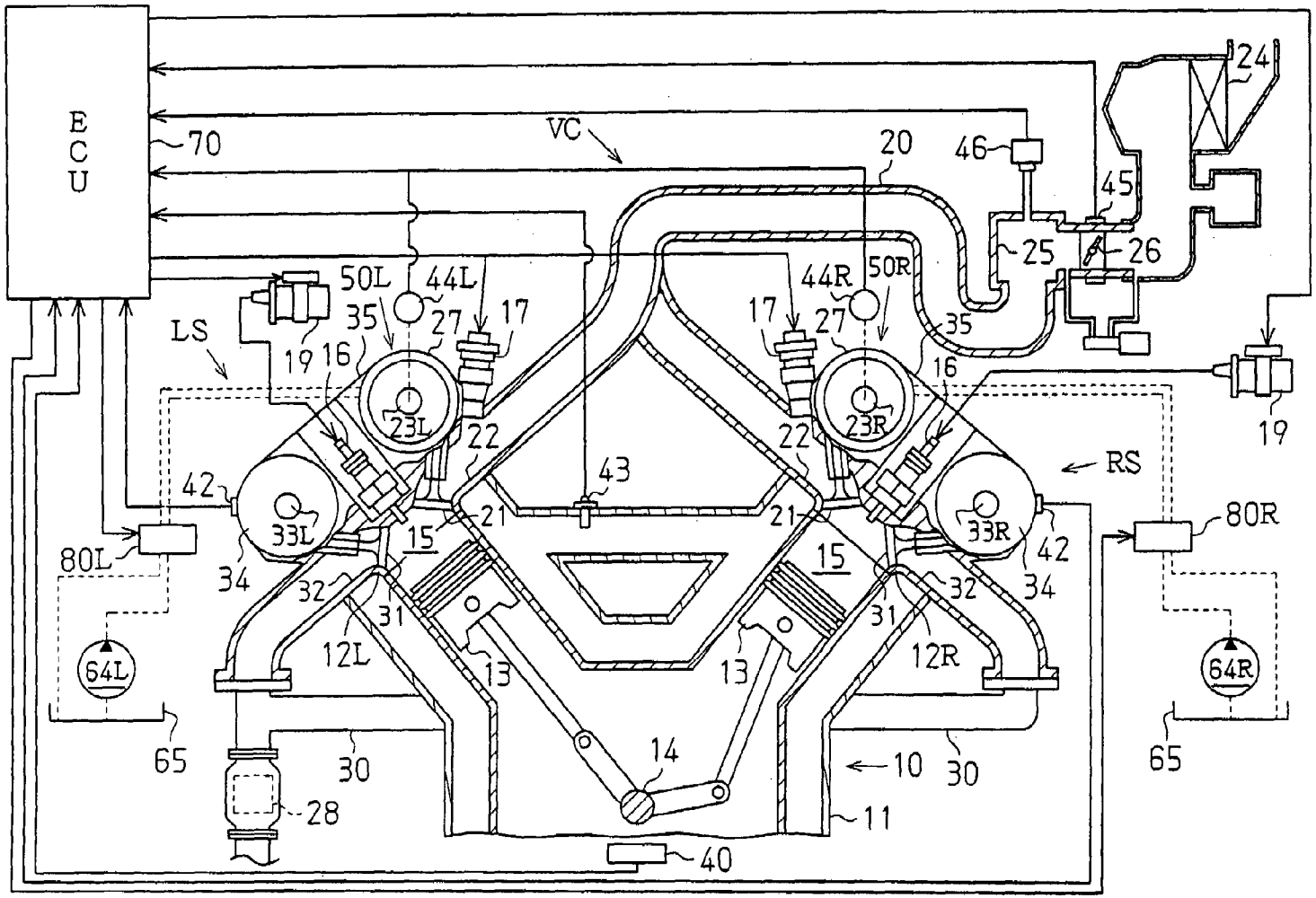
FIG. 1 schematically shows a gasoline engine system including a controller according to a preferred embodiment of the present invention.

A controller according to a preferred embodiment of the present invention is described hereinafter with reference to FIGS. 1 through 9. FIG. 1 schematically shows a vehicle gasoline engine system using the controller of the preferred embodiment.

An internal combustion V-type six-cylinder engine 10 is provided with a cylinder block 11 including a plurality of cylinders arranged in a V-shape with a predetermined angular spacing, and a right cylinder head 12R and a left cylinder head 12L connected to the top of the cylinder block 11. Accordingly, the engine 10 includes a left cylinder group LS and a right cylinder group RS.

The engine 10 is provided with pistons 13, each reciprocating in one of the cylinders provided in the cylinder block 11. A crankshaft 14 is coupled to the bottom end of each piston 13. The crankshaft 14 is rotated by the reciprocation of each piston 13.

A crank angle sensor 40 is disposed near the crankshaft 14, and the crank angle sensor 40 generates a cyclic pulse-type crank angle signal corresponding to the rotation speed of the crankshaft 14. As described later, an electronic control unit (ECU) calculates the rotation speed (engine speed) of the crankshaft 14 by counting the number of crank angle signals generated by the crank angle sensor 40 after a reference position signal has been generated by a cylinder distinguishing sensor 42.

The internal walls of the cylinder block 11 and cylinder heads 12L and 12R and the top of the pistons 13 form a combustion chamber 15 for the combustion of an air-fuel mixture. Spark plugs 16, for igniting the mixture, are installed in the top of the cylinder heads 12L and 12R so as to extend into the combustion chamber 15. Each spark plug 16 is connected to an igniter 19 through an ignition coil (not shown) and is supplied with a high voltage synchronously with the crank angle based on an ignition signal from the ECU 70.

Near the exhaust camshafts 33L and 33R of the cylinder heads 12L and 12R are respectively arranged cylinder distinguishing sensors 42, which generate reference position signals at predetermined rates in conjunction with the rotation of the exhaust camshafts 33L and 33R. The reference position signals are used to distinguish the cylinders and to detect the reference position of the crankshaft 14.

A coolant temperature sensor 43, for detecting the temperature of the coolant flowing through the coolant flow path, is mounted on the cylinder block 11. The ECU 70 uses the coolant temperature te as the engine temperature. Each of the cylinder heads 12L and 12R has intake ports 22 and exhaust ports 32. The intake ports 22 are connected to an intake passage 20, and the exhaust ports 32 are connected to an exhaust passage 30. An intake valve (engine valve) 21 is arranged at each intake port 22, and an exhaust valve 31 is arranged at each exhaust port 32 of the cylinder heads 12.

A left intake camshaft 23L for driving the intake valves 21 is arranged above each intake valve 21 of the left cylinder group LS. A right intake camshaft 23R for driving the intake valves 21 is arranged above each intake valve 21 of the right cylinder group RS. A left exhaust camshaft 33L for driving the exhaust valves 31 is arranged above each exhaust valve 31 of the left cylinder group LS. A right exhaust camshaft 33R for driving the exhaust valves 31 is arranged above each exhaust valve 31 of the right cylinder group RS.

Intake timing pulleys 27 are affixed on one end of both intake camshafts 23L and 23R, and exhaust timing pulleys 34 are affixed on one end of both exhaust camshafts 33L and 33R. The timing pulleys 27 and 34 are connected to the crankshaft 14 so as to rotate synchronously by means of a timing belt 35.

Accordingly, during the operation of the engine 10, a rotational drive force is transmitted from the crankshaft 14 to the camshafts 23L, 23R, 33L, and 33R through the timing belt 35 and the timing pulleys 27 and 34. Each intake valve 21 and each exhaust valve 31 are opened and closed by means of the rotation of the camshafts 23L, 23R, 33L, and 33R by the rotational drive force. The valves 21 and 31 are driven by a predetermined operation timing which is synchronized with the reciprocation of the pistons 13 and the rotation of the crankshaft 14, that is, synchronized with the series of four strokes in the engine 10 which include an intake stroke, a compression stroke, a combustion/expansion stroke, and an exhaust stroke.

Cam angle sensors 44L and 44R are respectively arranged near the intake camshafts 23L and 23R. The cam angle sensors 44L and 44R include electromagnetic pick-ups (not shown) and magnetic rotors (not shown) connected to the intake camshafts 23L and 23R. Furthermore, teeth are formed at equal intervals along the periphery of the magnetic rotor. The cam angle sensors 44L and 44R generate pulse-like cam angle signals in conjunction with the rotation of the intake camshafts 23.

An air cleaner 24 is connected to the air-intake inlet of the intake passage 20, and also disposed in the intake passage 20 is a throttle valve 26 which is driven in linkage with an accelerator pedal (not shown in the drawing). The amount of air introduced into the engine 10 is restricted by the opening and closing of the throttle valve 26.

A throttle sensor 45, for detecting the degree of throttle opening ta, is disposed near the throttle valve 26. Furthermore, a surge tank 25, for suppressing air intake pulsations, is arranged on the downstream side of the throttle valve 26. The surge tank 25 is provided with an intake pressure sensor 46 for detecting the intake pressure within the surge tank 25. An injector 17 for supplying fuel to the combustion chamber 15 is provided near the intake port 22 of each cylinder. The injectors 17 are electromagnetic valves which are opened by an electrical current. Fuel is supplied from a fuel pump (not shown in the drawing) to each injector 17.

Accordingly, during the operation of the engine 10, air filtered by the air cleaner 24 is introduced into the intake passage 20. Each injector 17 injects fuel toward each intake port 22 at the same time air is introduced. As a result, an air-fuel mixture is produced at each intake port 22, and this mixture is introduced into the combustion chamber 15 by means of the open intake valve 21 during the intake process. Then, the mixture in the combustion chamber 15 is burned, and an exhaust gas is generated. The exhaust gas is discharged into the atmosphere through a catalytic converter 28 disposed in the exhaust passage 30.

In the engine 10 of the preferred embodiment, variable valve timing mechanisms (hereinafter referred to as "VVT") 50L and 50R, which vary the timing operating characteristics of the intake valves 21, that is, vary the operation timing of the intake valves 21 to change the amount of valve overlap. The VVT 50L and VVT SOR are respectively provided on the intake timing pulleys 27 of the left cylinder group LS and right cylinder group RS and are driven by hydraulic force. The VVT 50L and VVT 50R continuously change the valve timing of the intake valve 21 by changing the actual relative rotation phase of the intake camshafts 23L and 23R relative to each intake timing pulley 27. Respectively connected to the VVT 50L and VVT 50R are oil control valves (hereinafter referred to as "OCV") 80L and 80R, and oil pumps 64L and 64R.

Figure 2:
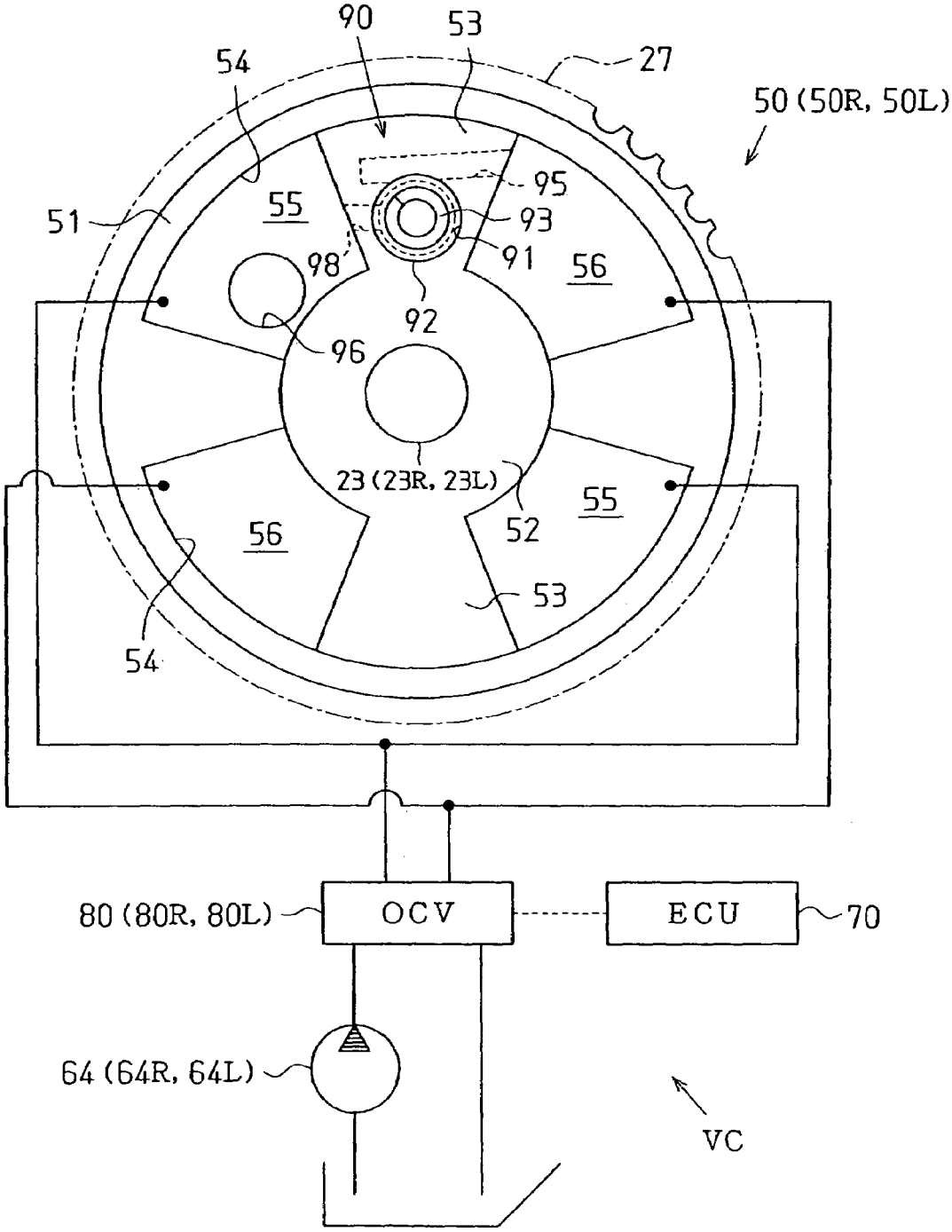
FIG. 2 schematically shows the controller of FIG. 1.

The system structure of the VVT 50L and 50R is described below with reference to FIGS. 2 and 3. For the sake of simplicity, FIG. 2 does not distinguish between the VVT 50L in the left cylinder group LS and the VVT 50R in the right cylinder group RS. FIG. 2 schematically shows the valve operating characteristics controller and the VVT 50 for the intake camshaft 23.

The controller of the VVT 50 is provided with the ECU 70. The ECU 70 restricts the intake valves 21 to a target valve timing (VVT control) by controlling the OCV 80 based on input signals from various sensors.

The VVT 50 shown in FIG. 2 has a generally circular housing 51, and a vane hub 52 accommodated within the housing 51. The housing 51 is connected to and rotates integrally with the intake timing pulley 27. The vane hub 52 is connected to and rotates integrally with the intake camshaft 23. In the preferred embodiment, the intake camshaft 23 rotates in the clockwise direction as viewed in FIG. 2.

A plurality of vanes 53 extending in the radial direction are formed on the circumference of the vane hub 52. A plurality of concavities 54 extending in the circumference direction are formed on the interior circumference of the housing 51 such that the vanes 53 are respectively disposed within the plurality of concavities 54. An advance pressure chamber 55 and a delay pressure chamber 56 are defined by the vanes 53 in the each concavity 54. Although two vanes 53 and two concavities 54 are shown in FIG. 2, the number of vanes and concavities may be modified as required.

The advance pressure chamber 55 and the delay pressure chamber 56 are each connected to the OCV 80 through a corresponding oil flow path. Operating oil is supplied from the oil pump 64, which is connected to the crankshaft 14, to the OCV 80. The OCV 80 restricts the amount of operating oil supplied to the advance pressure chamber 55 or the delay pressure chamber 56 according to the duty ratio dvt of the voltage supplied to the OCV 80. Specifically, the OCV 80 operates based on command signals from the ECU 70 to supply operating oil to the advance pressure chamber 55 and the delay pressure chamber 56, or discharge operating oil from the advance pressure chamber 55 and the delay pressure chamber 56. As a result, the vane hub 52 rotates relative to the housing 51 according to the difference in the hydraulic pressure of the advance pressure chamber 55 and the hydraulic pressure of the delay pressure chamber 56. The actual relative rotation phase of the intake camshaft 23 therefore changes relative to the intake timing pulley 27, thereby changing the valve timing of the intake valve 21.

The valve timing control in the VVT 50 is specifically performed as described below.

The ECU 70 receives signals representing engine operating conditions, such as signals relating to coolant temperature information from the coolant temperature sensor 43, crank angle signals from the crank angle sensor 40, reference position signals from the cylinder distinguishing sensor 42, cam angle signals from the cam angle sensors 44L and 44R, and signals relating to the throttle opening ta from the throttle sensor 45. The ECU 70 calculates the target relative rotation phase (hereinafter referred to as "target phase") vtt of the vane hub 52 to achieve a valve timing suitable for the engine operating conditions based on parameters included in these signals. The ECU 70 determines the actual relative rotation phase (hereinafter referred to simply as "actual phase") vt of the vane hub 52 based on the crank angle signals and cam angle signals.

When the actual phase vt differs from the target phase vtt, the ECU 70 controls the OCV 80 by setting the duty ratio dvt so as to discharge operating oil from one of the advance pressure chamber 55 and the delay pressure chamber 56 and supply operating oil to the other one of the advance pressure chamber 55 and the delay pressure chamber 56. As a result, the vane hub 52 is rotated relative to the housing 51 in accordance with the pressure difference between the advance pressure chamber 55 and the delay pressure chamber 56 such that the actual phase vt approaches the target phase vtt.

When the target phase vtt and actual phase vt match as a result of this adjustment, the ECU 70 sets the duty ratio dvt to a holding duty ratio K (for example, approximately 50%) to stop the supply and discharge of operating oil to and from the advance pressure chamber 55 and delay pressure chamber 56. As a result, the actual phase vt of the vane hub 52 is maintained by uniformly maintaining the pressures of the advance pressure chamber 55 and the delay pressure chamber 56.

In the control of the OCV 80, the ECU 70 sets the duty ratio dvt in accordance with the difference between the target phase vtt and the actual phase vt. That is, the greater the difference between the target phase vtt and the actual phase vt, the ECU 70 sets the duty ratio dvt farther from the holding duty ratio K.

Furthermore, when the target phase vtt is on the advance side of the actual phase vt, the ECU 70 sets the duty ratio dvt at a value between the holding duty ratio K and 100%. In this case, the farther the duty ratio dvt is from the holding duty ratio K, the greater the pressure of the advance pressure chamber 55 becomes relative to the pressure of the delay pressure chamber 56. Conversely, when the target phase vtt is on the delay side of the actual phase vt, the ECU 70 sets the duty ratio dvt at a value between the holding duty ratio K and 0%. In this case, the farther the duty ratio dvt is from the holding duty ratio K, the greater the pressure of the delay pressure chamber 56 becomes relative to the pressure of the advance pressure chamber 55. That is, the greater the difference between the target phase vtt and the actual phase vt, the greater the pressure difference between the two pressure chambers 55 and 56. As a result, the actual phase vt rapidly converges on the target phase vtt.

The vane hub 52 in the VVT 50 is capable of relative rotation within a range from a phase in which the vane 53 is in contact with one wall of the concavity 54 to a phase in which the vane 53 is in contact with the opposite wall of the concavity 54. The phase range of this relative rotation is equivalent to the control range of the actual phase vt in the valve timing control of the preferred embodiment. Below, the farthest position to which the vane hub 52 relatively rotates in the delaying direction (the direction opposite to the rotation direction of the intake camshaft 23) is referred to as the "most delayed position." The most delayed position is set as the initial position of the vane hub 52 when the OCV 80 is not controlled by the ECU 70, that is, the position when the engine is stopped. The farthest position to which the vane hub 52 relatively rotates in the advancing direction (the rotation direction of the intake camshaft 23) is referred to as the "most advanced position." In the VVT 50 of the preferred embodiment, the vane hub 52 relatively rotates in a range from the most delayed position to the most advanced position by the pressure control of the advance pressure chamber 55 and the delay pressure chamber 56.

The VVT 50 is provided with a lock mechanism 90 for controlling (locking) the relative rotation of the vane hub 52 during pressure drops, such as when starting the engine. As shown in FIG. 2, a stepped receiving hole 91, which extends parallel to the axial direction of the intake camshaft 23, is formed in one of the plurality of vanes 52. A lock pin 92 is arranged so as to reciprocate in the receiving hole 91.

Figure 3:
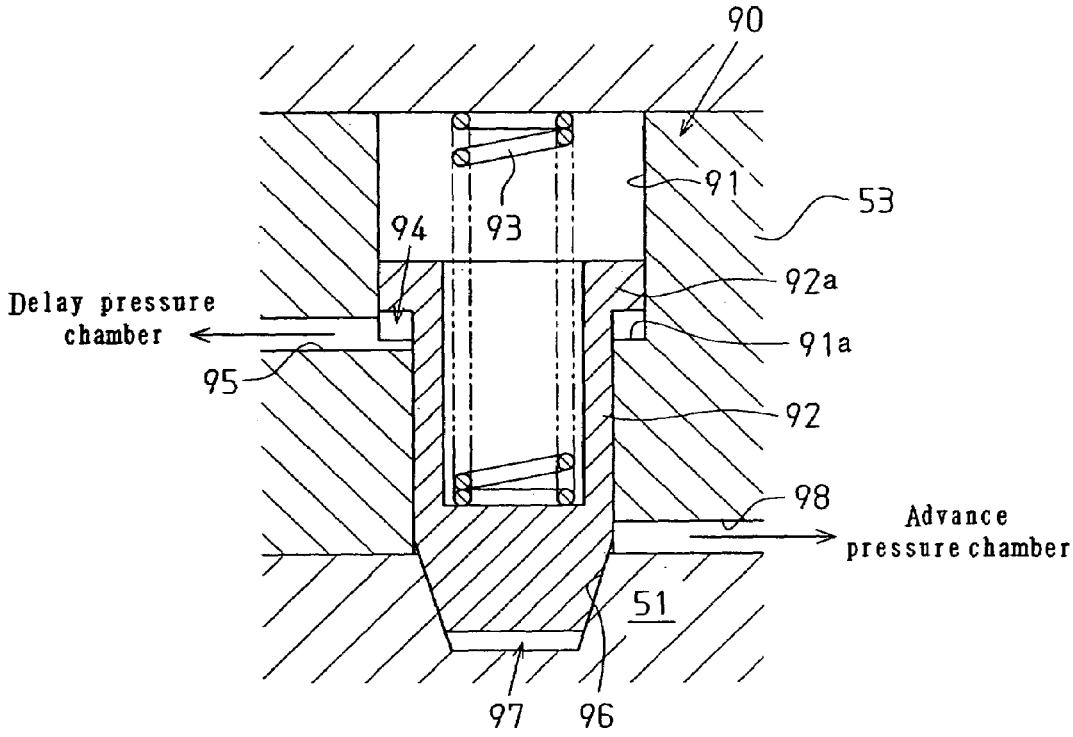
FIG. 3 is a cross sectional view of the lock mechanism included in the controller of FIG. 1.
Figure 4:
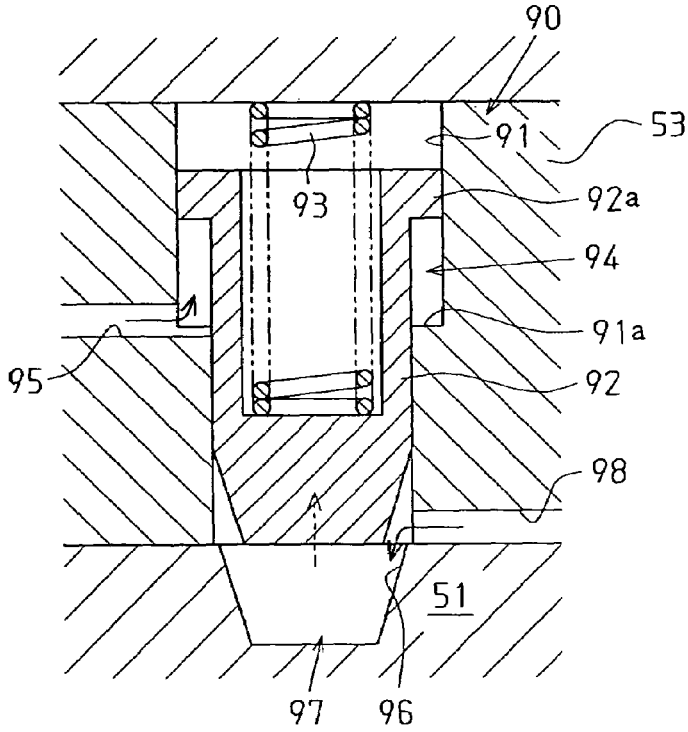
FIG. 4 is a cross sectional view of the lock mechanism of FIG. 3.

The lock pin 92 moves along the axial direction of the intake camshaft 23 between the projected position shown in FIG. 3 and the retracted position shown in FIG. 4 in a state in which the exterior surface of the pin 92 slides on the interior surface of the receiving hole 91. The lock pin 92 is forced toward the housing 51 by a spring 93. A step 92*a* having an enlarged diameter is formed on the base end of the lock pin 92. A ring-like unlock pressure chamber 94 is formed between the step 92*a* and a step 91*a* of the receiving hole 91. A delay oil path 95, which is a communicating passage between the unlock pressure chamber 94 and the delay pressure chamber 56, is formed in the vane 53. The pressure of the delay pressure chamber 56 is transmitted to the unlock pressure chamber 94 through the delay oil path 95. Accordingly, when the pressure of the delay pressure chamber 56 increases, the pressure of the unlock pressure chamber 94 also increases.

A lock hole 96, into which the lock pin 92 is inserted when the vane hub 52 is disposed at the most delayed position, is formed in the housing 51. As shown in FIG. 3, when the lock pin 92 is inserted into the lock hole 96 by the force exerted by the spring 93, the vane hub 52 is mechanically fixed to the housing 51, and the relative rotation of the vane hub 52 is restricted (locked). That is, in this state (lock state) of restricted relative rotation (variable operation), the actual phase vt is maintained at the most delayed phase (lock phase). The lock mechanism 90 locks the valve timing of the intake valves 21 at a predetermined lock value by locking the change operation of the actual phase vt when the actual phase vt of the intake camshaft 23 attains a predetermined lock phase.

An unlock pressure chamber 97 is defined between the tip of the lock pin 92 and the wall of the lock hole 96. An advance oil path 98, which is a communicating passage between the unlock pressure chamber 97 and the advance pressure chamber 55, is formed on the sliding surface of the vane 53 and housing 51. The pressure of the advance pressure chamber 55 is transmitted to the unlock pressure chamber 97 through the advance oil path 98. Accordingly, when the pressure of the advance pressure chamber 55 increases, the pressure of the unlock pressure chamber 97 also increases.

The oil operating pressure of the unlock pressure chambers 94 and 97 acts in a direction to disengage the lock pin 92 from the lock hole 96. Accordingly, when the pressure of one or both of the advance pressure chamber 55 and the delay pressure chamber 56 increases, and the pressure of the unlock pressure chambers 94 and 97 increases sufficiently, the lock pin 92 is moved in a direction separating the pin 92 from the lock hole 96, as shown in FIG. 4. Therefore, the lock mechanism 90 unlocks the relative rotation of the vane hub 52. In the preferred embodiment, a state in which the lock mechanism 90 unlocks relative rotation is referred to as an unlock state.

In the preferred embodiment, the unlock pressure chamber 97, which is connected to the advance pressure chamber 55, has an area, on which the hydraulic pressure acts to release (disengage) the lock pin 92 from the lock hole 96, greater than that of unlock pressure chamber 94, which is connected to the delay pressure chamber 56. That is, the force acting on the lock pin 92 in a direction disengaging (disengaging) the lock pin 92 from the lock hole 96 is more affected by the pressure of the advance pressure chamber 55 than the pressure of the delay pressure chamber 56.

In the preferred embodiment, the relative rotation of the vane hub 52 is locked at the most delayed position, that is the lock phase, when the hydraulic pressure is low immediately after starting the engine 10. Thereafter, the oil pumps 64L and 64R are capable of supplying sufficient oil to the pressure chambers 55 and 56 in accordance with the rise in the engine speed ne. Then, the lock mechanism 90 releases the lock on the relative rotation of the vane hub 52, and the VVT 50 changes the actual phase vvt of the vane hub 52. The ECU 70 performs control for early unlocking of the relative rotation of the vane hub 52. Results of this control are the suppression of torque fluctuation caused by the difference in the actual phases vt, that is, the difference in the valve timings between both cylinder groups LS and LR in the engine 10, and a rapid realization of a valve timing suitable for the operating conditions of the engine 10.

Details of the process sequence of the control of the VVT 50 performed by the ECU 70 are described below with reference to the flowcharts of FIGS. 5 through 8.

The series of processes shown in these flowcharts are alternately repeated for the left cylinder group LS and the right cylinder group LR in predetermined control cycles executed by the ECU 70.

Figure 5:
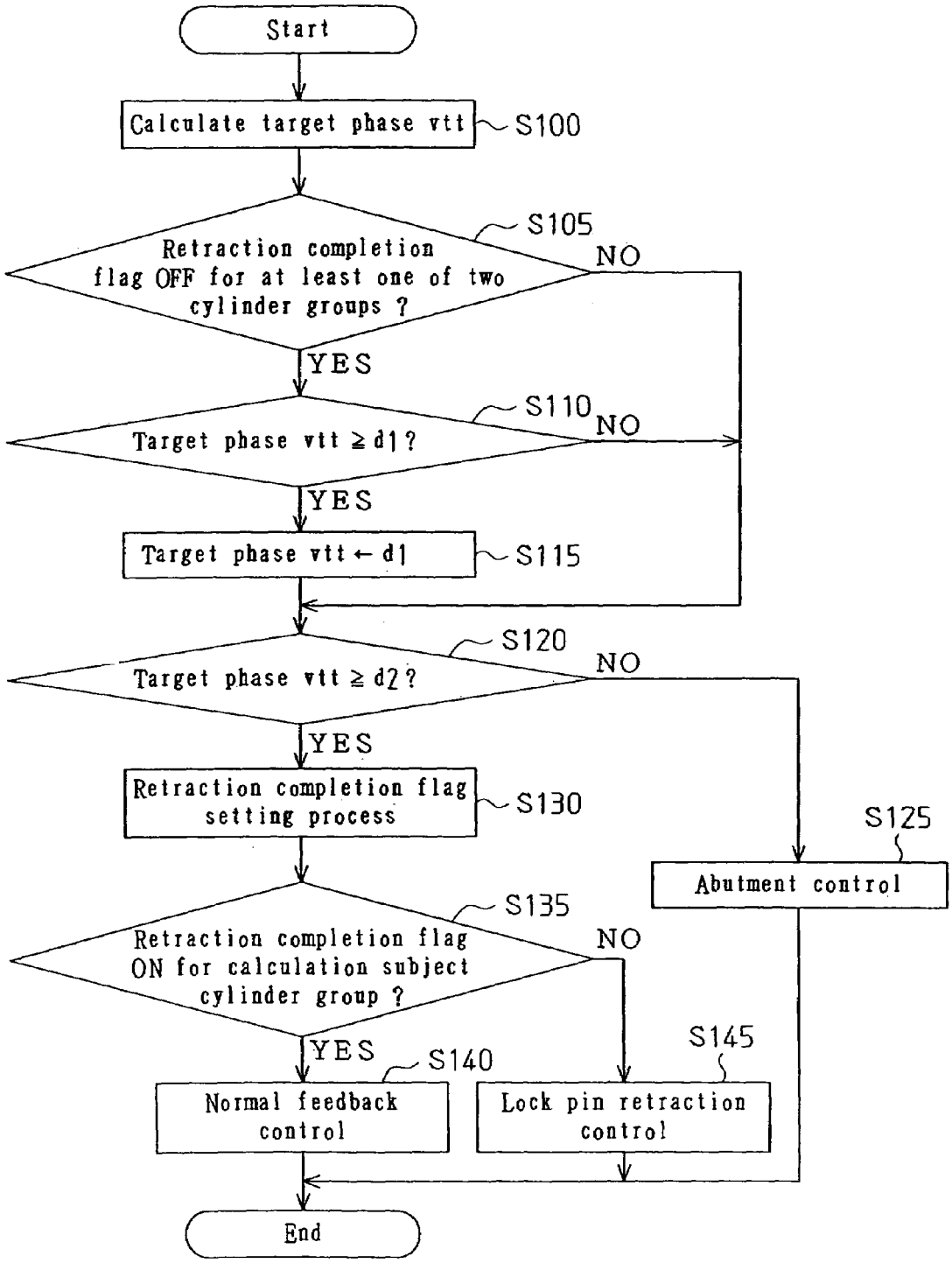
FIG. 5 is a main flowchart showing the processing performed by the ECU incorporated in the controller of FIG. 1.

As shown in the flowchart of FIG. 5, the ECU 70 first calculates the target phase vtt in step S100. As previously described, the ECU 70 calculates the target phase vtt based on the previously mentioned parameters so as to realize a valve timing suitable for the operating conditions of the engine 10. The ECU 70 performs the processes of step S100 as a setting means for setting the target phase vtt, that is, the target valve timing (target value) based on the operating conditions of the engine 10. In the preferred embodiment, the target phase vtt and the actual phase vt are set using the previously mentioned lock phase as a reference (zero). The target phase vtt increases, as the vane hub 52 separates from the lock phase to the advance side.

In step S105, the ECU 70 determines whether or not the retraction completion flag is OFF for at least one of the cylinder groups LS and RS. The "retraction completion flag" indicates whether or not the lock pin 92 has been disengaged (completely retracted) from the lock hole 96, that is, whether or not the lock mechanism 90 is in the unlocked state.

Specifically, the retraction completion flag is set to OFF in the locked state in which the lock pin 92 is inserted into the lock hole 96, and set to ON in the unlocked state in which the lock pin 92 is disengaged from the lock hole 96. In the initial state, the retraction completion flag is set to OFF beforehand for both cylinder groups LS and RS.

In the preferred embodiment, the ECU 70 functions as a means for determining whether or not the lock mechanism 90 is in the locked state or unlocked state in step S105 and after-mentioned step S130.

When the determination result is YES in step S105, that is, when it is determined that at least one lock mechanism 90 of the two cylinder groups LS and RS is in a locked state, the process proceeds to step S110. Conversely, when the determination result is NO in step S105, that is, when it is determined that the lock mechanisms 90 of both cylinder groups LS and RS are in the unlocked state, the process proceeds to step S120.

In step S110, the ECU 70 determines whether or not the target phase vtt calculated in step S100 is greater than a predetermined phase (predetermined limit value) d1. The predetermined phase d1 is set to a value greater than zero, that is, to a phase on the advance side of the lock phase.

When the determination result is YES in step S110, that is, when the target phase vtt is greater than the predetermined phase d1, the ECU 70 sets the target phase vtt to the predetermined phase d1 in step S115. That is, when the target phase vtt calculated in step S100 is greater than the predetermined phase d1, the target phase vtt is replaced by the predetermined value d1. When the target phase vtt is equal to the predetermined value d1, the target phase is maintained without any changes. When the determination result is NO in step S110, that is, when the target phase vtt calculated in step S100 is less than the predetermined phase d1, the target phase vtt value is not replaced, and the process proceeds to step S120. The target phase vtt is restricted within a range below the predetermined phase d1 by means of these processes.

When the ECU 70 (determination means) determines that at least one of the two lock mechanisms 90 is in the locked state, in step S115, the ECU 70 restricts the target phase vtt of each VVT 50 within a restricted range from the lock phase to the predetermined phase d1. That is, in step S115, the ECU 70 functions as a restricting means for restricting the valve timing target value for the VVT 50 in the unlocked state so as to reduce the difference in the lock values. Furthermore, in step S110, the ECU 70 functions as a prohibition means to prohibit the restriction of the target phase vtt by the restricting means when the target phase vtt is on the lock phase side of the predetermined phase d1.

When the OCV 80 is actuated so as to have the actual phase vt of the vane hub 52 approach the restricted target phase vtt, the actual phase vt is restricted to less than the predetermined phase d1. For example, one of the two VVTs 50 may be in the locked state, and the other VVT 50 may be in an unlocked state. In this case, the difference between the actual phases vt between the two VVTs 50, that is, between the two cylinder groups LS and RS, is restricted to less than the predetermined phase d1 even when the unlocked vane hub 52 is relatively rotated by the actuation of the OCV 80. The predetermined phase d1 is set to a value capable of sufficiently restricting the torque fluctuation of the engine 10 which is caused by the difference between the actual phases vt, that is, the difference between the valve timings.

In step S120, the ECU 70 determines whether or not the target phase vtt is greater than or equal to the predetermined phase d2. The predetermined phase d2 is set such that the following relationship is satisfied: 0<d2<d1. When the determination result is NO in step S120, that is, when the target phase vtt is less than the predetermined phase d2, the ECU 70 executes abutment control in step S125. In the abutment control, the ECU 70 performs hydraulic pressure control for inducing relative rotation of the vane hub 52 toward the most delayed position to ensure the setting of the actual phase vt to zero.

Specifically, the ECU 70 sets the duty ratio dvt of the voltage applied to the OCV 80 to "K—X." Here, K is the previously mentioned holding duty ratio, and X is a predetermined duty ratio (for example, 20%) set so as to ensure relative rotation of the vane hub 52 to the most delayed position. Accordingly, in the preferred embodiment, when the target phase vtt is greater than the predetermined phase d2 at the process of step S120, the vane hub 52 relatively rotates toward the most delayed position and does not relatively rotate toward the target phase vtt.

When the determination result is YES in step S120, the ECU 70 executes the retraction completion flag setting process in step S130. In the retraction completion flag setting process, the ECU 70 sets the ON/OFF state of the flag subject to determination in step S105 based on the operating conditions of the engine 10.

Figures 6, 7:
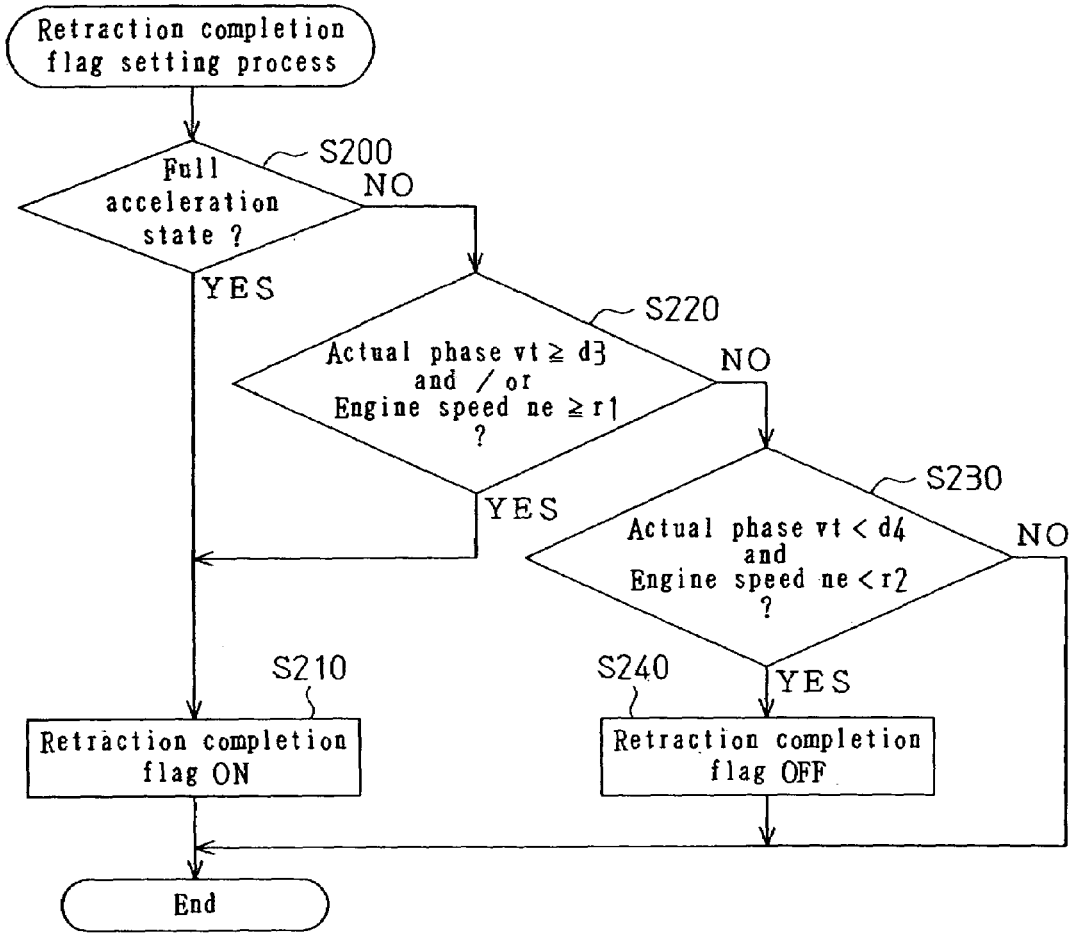
FIG. 6 is a flowchart showing the processing in the retraction-complete flag setting process of the preferred embodiment.
FIG. 7 is a map showing the relationship between coolant temperature and a predetermined speed in the preferred embodiment.

Specifically, in the retraction completion flag setting process shown in the flowchart of FIG. 6, the ECU 70 first determines whether or not the engine 10 is in the full acceleration state in step S200. For example, the ECU 70 determines the full acceleration state based on whether or not the throttle opening ta detected by the throttle sensor 45 exceeds a predetermined angle (for example, 30 degrees). The ECU 70 determines the presence of the full acceleration state if the throttle opening ta exceeds a predetermined angle, and determines the presence of a non-full acceleration state when the predetermined angle is not exceeded.

When the determination result is YES in step S200, that is, when the engine 10 is in the full acceleration state, the engine speed ne is considered to rise rapidly. Accordingly, the discharge pressure of the oil pump 64, which rises quickly in conjunction with the rapid rise in the engine speed ne, is regarded as a sufficient value for disengaging the lock pin 92 from the lock hole 96, and the ECU 70 sets the retraction completion flag to ON in step S210. When the determination result is NO in step S200, the process moves to step S220.

In step S220, the ECU 70 determines whether or not at least one condition is established among the condition of the actual phase vt exceeding the predetermined phase d3, and the condition of the engine speed ne exceeding a predetermined speed r1. The predetermined phase d3 is set so as to satisfy the relationship "0<d3<d1." If the actual phase vt is greater than or equal to the predetermined phase d3, it is considered that the vane hub 52 is completely removed from the lock position (most delayed position) and the lock mechanism 90 is in the unlocked state. The predetermined speed r1 is the value of the engine speed in a hypothetical state in which the discharge pressure of the oil pump 64 driven by the engine 10 is more than sufficiently high so as to set the lock mechanism 90 in the unlocked state. That is, when the determination result is YES in step S220, the ECU 70 sets the retraction completion flag to ON in step S210.

When the determination result is NO in step S220, the ECU 70 determines whether or not the actual phase vt is less than a predetermined phase d4 and the engine speed ne is less than a predetermined speed r2. The predetermined phase d4 is set so as to satisfy the relationship of "0<d4<d3." When the actual phase vt is less than the predetermined phase d4, there is a high possibility that the vane hub 52 is at or near the lock position, and the lock mechanism 90 is set to the locked state. The predetermined speed r2 is set so as to satisfy the relationship "0<r2<r1." The predetermined speed r2 is the engine speed hypothesized when the discharge pressure of the oil pump 64 is insufficient to set the lock mechanism 90 to the unlocked state.

When the determination result is YES in step S230, the ECU 70 regards the lock mechanism 90 as set to the locked state by the current actual phase vt and engine speed ne. Accordingly, the ECU 70 sets the retraction completion flag to OFF in step S240. When the determination result is NO in step S230, the ECU 70 does not perform the retraction completion flag setting process in steps S210 and S240, and the process of the flowchart in FIG. 6 ends. In the retraction completion flag setting process of the preferred embodiment, a numerical difference may exist between the determination reference values of step S220 (predetermined phase d3 and predetermined speed r1), and the determination reference values of step S230 (predetermined phase d4 and speed r2). Between steps S220 and S230 exists a relationship of hysteresis relating to the aforesaid numerical difference.

In the preferred embodiment, the ECU 70 sets the predetermined speed r1 in accordance with the coolant temperature te detected by the coolant temperature sensor 43. For example, the ECU 70 sets the predetermined speed r1 based on a map M101 such as that shown in FIG. 7. The map M101 represents the relationship between the coolant temperature te and the predetermined speed ne, and is stored beforehand in the ECU 70. The higher the coolant temperature te, the higher the predetermined speed r1, as shown in map M101. The predetermined speed r2 is set at a value obtained by subtracting the hysteresis component from the predetermined speed r1.

The predetermined speeds r1 and r2 are set according to the coolant temperature because the discharge pressure of the oil pump 64 may differ due to the effects of oil viscosity changing in conjunction with oil temperature even at the same engine speed ne. If the coolant temperature te is high, the oil temperature is assumed to be high and the oil viscosity low due to the influence of the coolant. In this case, the hydraulic pressure of the oil pump 64 is considered to be relatively low. For this reason, the ECU 70 sets the predetermined speeds r1 and r2 according to the temperature te using the coolant temperature te as a parameter for estimating the oil temperature. In this way, the ECU 70 adjusts the predetermined speeds r1 and r2 used as reference values for determinations by the change in the discharge pressure of the oil pump 64 caused by the influence of oil temperature.

In step S135, the ECU 70 determines whether or not the retraction completion flag is ON for cylinder group LS or RS currently subject to processing (calculation subject cylinder group). When the determination result is YES in step S135, that is, when the lock mechanism 90 of the calculation subject cylinder group is regarded as being in the unlocked state, the process proceeds to step S140, and the ECU 70 executes normal feedback control. In the normal feedback control, the ECU 70 calculates the duty ratio dvt corresponding to the difference between the target phase vtt and the actual phase vt as described previously. Then, the ECU 70 controls the OCV 80 using the calculated duty ratio dvt so as to cause the actual phase vt to approach the target phase vtt.

For example, in step S140, the lock mechanism 90 of the calculation subject cylinder group is in an unlocked state, and the lock mechanism 90 of the other cylinder group is in a locked state. The VVT 50 of the calculation subject cylinder group is controlled such that the actual phase vt approaches the target phase vtt which is limited within a restricted range (less than predetermined phase d1). The vane hub 52 of the VVT 50 in the locked state is at the lock position. Accordingly, the difference in the actual phases vt between the two cylinder groups LS and RS is limited to less than or equal to the predetermined phase d1. As a result, torque fluctuation of the engine 10 caused by the actual phase vt difference, that is, the difference in valve timings, is limited.

When the lock pin 92 is disengaged from the lock hole 96 in the condition in which there is a pressure difference between the two pressure chambers 55 and 56, there is a friction force between the lock pin 92 and the lock hole 96 and the friction force acts in the opposite direction to the direction of disengaging of the lock pin 92. This friction force is a resistance force countering the disengagement of the lock pin 92, which hinders the transition from the locked state to the unlocked state, and is a source of unlock failure.

In recent years the actual engine speed range of the engine 10 has become lower, and it has thus become difficult to ensure the discharge pressure of the oil pump 64. Accordingly, the force for moving the lock pin 92 in the disengaging direction is insufficient, and unlock dysfunction readily occurs. Furthermore, there is a tendency to design the VVT 50 with increased volume and reduce the friction resistance between the intake valve 21 and intake camshaft 23 so as to improve the response of the VVT 50. The improved response obtained in this way tends to increase the resistance force before disengagement of the lock pin 92 is completed. This leads to unlock failure.

Accordingly, in order to shift the lock mechanism 90 to the unlocked state, it is desirable to eliminate the pressure difference between the two pressure chambers 55 and 56 by having the OCV 80 control the hydraulic pressure. In other wards, it is desirable to realize a condition in which the relative rotation force by the hydraulic pressure does not act on the vane hub 52. In this condition, the previously mentioned resistance is absent, and lock pin 92 is smoothly disengaged from the lock hole 96. To realize the absence of this pressure differential, the duty ratio dvt may be set to the holding duty ratio K in the control of the OCV 80. Actually, however, when the pressure differential actually becomes zero between the pressure chambers 55 and 56, the duty ratio dvt is dispersed and differs from the holding duty ratio K due to the change in the operating oil temperature or engine speed ne. Accordingly, the relative rotation force acts on the vane hub 52 by the degree of the dispersion so as to produce the resistance force even when the duty ratio dvt is set to the holding duty ratio K.

In the preferred embodiment, when the determination result is NO in step S135, that is, the lock mechanism 90 of the calculation subject cylinder group is regarded as being in the locked state, the ECU 70 executes the lock pin retraction control in step S145. In the lock pin retraction control, the ECU 70 controls the hydraulic pressure supplied to the VVT 50 to move the locked lock mechanism 90 as quickly as possible to the unlocked state. Specifically, the ECU 70 quickly moves the lock mechanism 90 to the unlocked state by gradually changing the duty ratio dvt from the lower limit to the upper limit within the predetermined range. The predetermined range includes the holding duty ratio K, such that the lower limit value of the predetermined range is less than the holding duty ratio K and the upper limit is greater than the holding duty ratio K.

Figure 8:
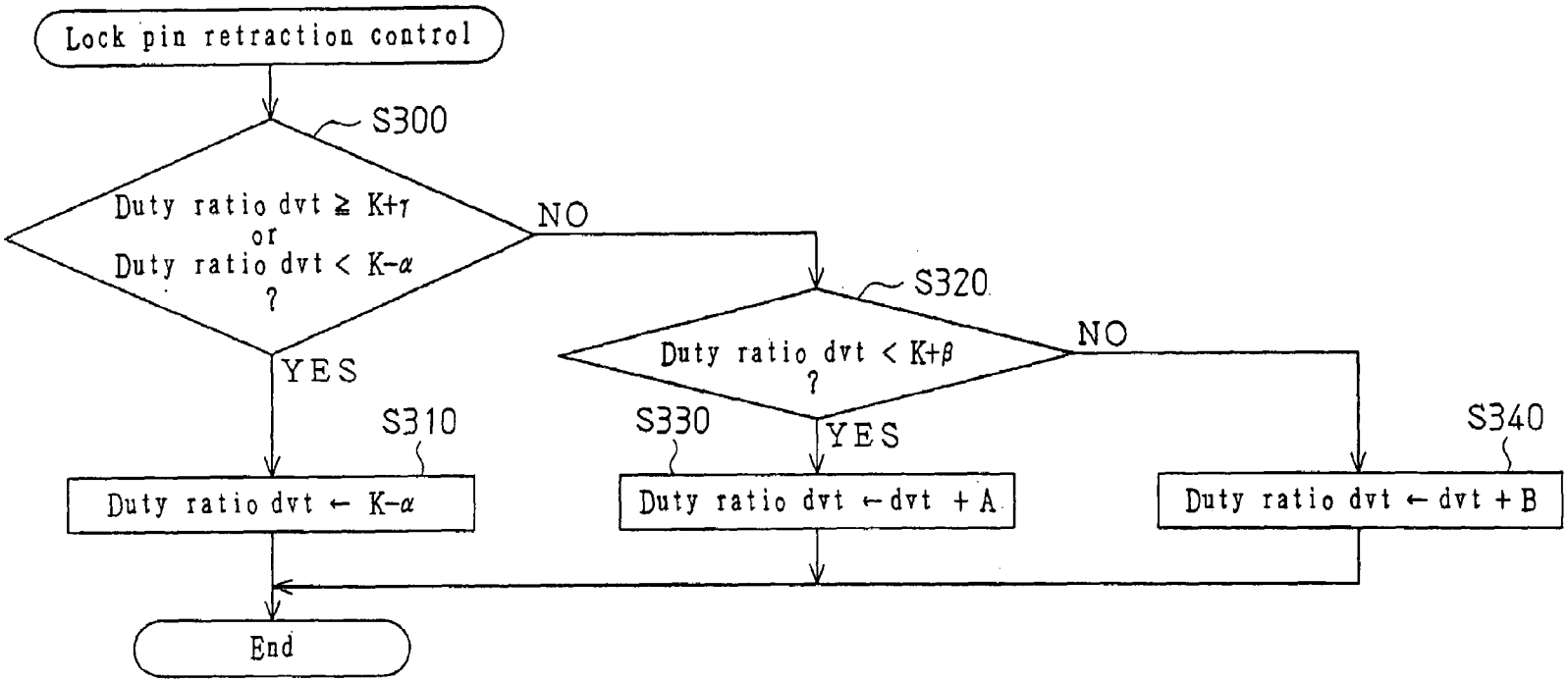
FIG. 8 is a flowchart showing the processing in the lock pin retraction control process of the preferred embodiment.

In the lock pin retraction control as shown in the flowchart of FIG. 8, first, in step S300, the ECU 70 determines whether or not the currently set duty ratio dvt is greater than or equal to "K+γ", or is less than "K−α". The value K is the previously mentioned holding duty ratio. Further, α is set so as to satisfy the relationship "0<α<X." The duty ratio dvt when the pressure differential between the pressure chambers 55 and 56 is actually zero is dispersed from the holding duty ratio K to the delay side, and the value α is set at a predetermined duty ratio (for example, 5%) greater than the maximum duty ratio of the dispersion. "K−α" is equivalent to the lower limit value of the predetermined range. Furthermore, γ is set so as to satisfy the relationship "α<γ." The duty ratio dvt when the pressure differential between the pressure chambers 55 and 56 is actually zero, is dispersed from the duty ratio K to the advance side, γ is set to a predetermined duty ratio greater than the maximum duty ratio of the dispersion. "K+γ" is equivalent to the upper limit of the predetermined range.

When the determination result is YES in step S300, the ECU 70 regards the duty ratio dvt as outside the predetermined range, and the value of the duty ratio dvt is replaced by the lower limit value "K−α" in step S310. Then, the ECU 70 actuates the OCV 80 using the duty ratio dvt.

After the process in the flowchart of FIG. 5 starts, the ECU 70 may execute the determination process in step S300 without executing the process for setting the duty ratio dvt in step S125 or step S140. In this case, the ECU 70 determines the duty ratio dvt previously set as the initial value, for example, a predetermined duty ratio dvt less than "K−α." In this instance, the ECU 70 sets the duty ratio to "K−α" in step S310.

Alternatively, when the determination result is NO in step S300, the ECU 70 determines whether or not the duty ratio dvt determined in step S300 is less than "K+β" in step S320. Here, β is set to a predetermined value satisfying the relationship "β<γ." In the preferred embodiment, actual experiments made clear that it is highly probable that the duty ratio dvt, when the pressure differential between the pressure chambers 55 and 56 is zero, lies within a range from "K−α" to "K+β" (not including the value "K+β") which is in the predetermined range. That is, in step S320, the ECU 70 determines whether or not the subject duty ratio dvt in the predetermined range is in a range in which the transition to the unlocked state is likely.

When the determination result is YES in step S320, that is, when there is a high possibility that the lock mechanism 90 can shift to the unlocked state, the process proceeds to step S330. Conversely, when the determination result is NO in step S320, that is, when there is a low possibility that the lock mechanism 90 can shift to the unlocked state, the process proceeds to step S340.

In step S330, the ECU 70 adds the predetermined duty ratio A to the current duty ratio dvt. Then, the ECU 70 actuates the OCV 80 using the added duty ratio dvt. In step S340, the ECU 70 adds a predetermined duty ratio B to the current duty ratio dvt. Then, the ECU 70 actuates the OCV 80 using the added duty ratio dvt.

Accordingly, the duty ratio dvt is gradually increased when the ECU 70 repeatedly executes the processes of steps S330 and S340. In this case, the predetermined duty ratios A and B are set so as to satisfy the relationship "0<A<B." For example, when the process of step S330 is repeated, the duty ratio dvt increases more moderately than when the process of step S340 is repeated. In this way the duty ratio dvt increase more slowly in the range in which there is a high possibility of the lock mechanism 90 shifting to the unlocked state in a predetermined range compared to a range of low possibility.

Figure 9:
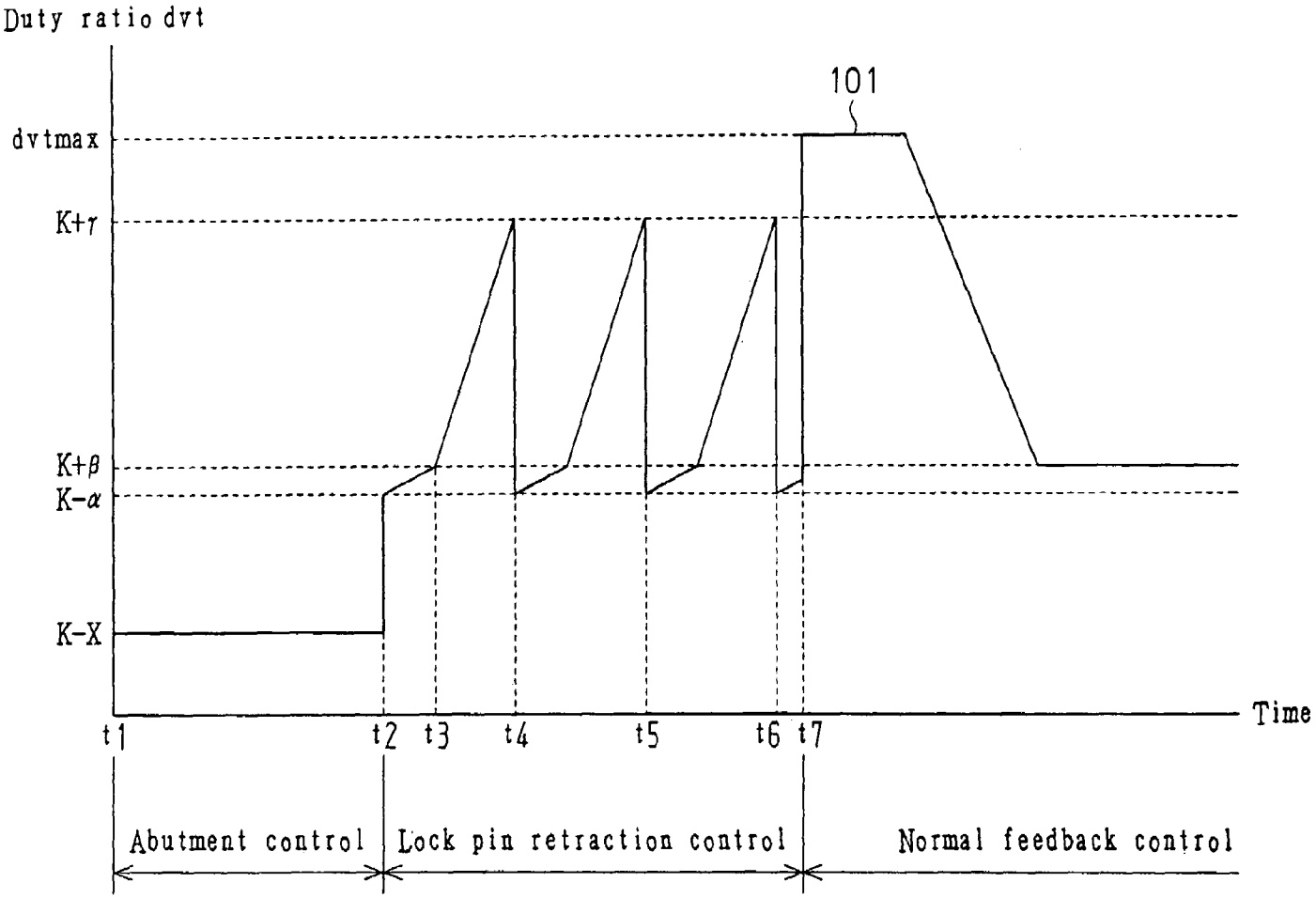
FIG. 9 is a timing chart showing the change in the duty ratio in the preferred embodiment.

In the calculation subject cylinder group, the duty ratio dvt changes, for example, as indicated by line 101 in the timing chart of FIG. 9, by repeating cycles of the series of processes shown in FIGS. 5, 6, and 8.

Referring to FIG. 9, at time t1, the duty ratio dvt is maintained at "K−X" by the abutment control. Thereafter, when the target phase vtt is set above d2 (but the calculation subject cylinder group is locked), the duty ratio dvt is replaced by "K−α" at time t2. Thereafter, the duty ratio dvt moderately and linearly increases. When the duty ratio dvt attains "K+β" at time t3, the duty ratio dvt increases more rapidly than heretofore. Then, when the duty ratio dvt attains "K+γ," the duty ratio dvt is again set to "K−α" at time t4.

While the duty ratio dvt is changing from "K−α" to "K+γ," the direction of the relative rotation acting on the vane hub 52 switches from the delay side to the advance side. At the moment this switch occurs, needless to say, the pressure differential between the pressure chambers 55 and 56 is zero, and the lock pin 92 readily disengages from the lock hole 96. In the preferred embodiment, as described previously, the duty ratio dvt when this pressure differential is actually zero is very likely in a range from "K−α" to "K+β" (not including the value "K+β"). For this reason, the ECU 70 sets a moderate increasing rate for the duty ratio dvt in this range from "K−α" to "K+β" compared to the increasing rate of the duty ratio dvt in the range from "K+β" to "K+γ." That is, the ECU 70 moderately increases the duty ratio dvt in the range in which there is a high possibility of the lock mechanism 90 shifting to the unlocked state. In this way, the ECU 70 slowly increases the pressure difference between the pressure chambers 55 and 56 in conjunction with the increase in the duty ratio dvt, and this slowly increases the resistance countering the disengagement of the lock pin 92. The disengagement of the lock pin 92 from the lock hole 96 is ensured through this action.

In the range from "K+β" to "K+γ" which is considered to have a low possibility of shifting to the unlocked state, the ECU 70 rapidly increases the duty ratio dvt compared to the range from "K−α" to "K+β." In this way, the time required for duty ratio dvt to attain "K+y" is reduced compared to when the duty ratio dvt is increased moderately in the range "K+β" to "K+γ" same as in the range from "K−α" to "K+β." If the time required for the lock pin retraction control is increased, then the start of the normal feedback control is delayed by the extent of that increase. Then, the obtainment of a valve timing suitable for the engine operating conditions is delayed. This is uncomfortable to the driver. Accordingly, in order to avoid this situation, it is advantageous that the time required for the lock pin retraction control is shortened.

The ECU 70 repeats the duty ratio dvt addition and subtraction control of time t2 to t4 until the retraction completion flag is set to ON for the calculation subject cylinder group (time t4 to t7). When the retraction completion flag changes from OFF to ON (time t7), the ECU 70 proceeds to the normal feedback control. In line 101, the ECU 70 gradually decreases the duty ratio dvt after setting it to dvtmax, which is greater than "K+γ", in accordance with the difference between the target phase vtt and the actual phase vt.

The ECU 70 and OCV 80 form a drive means for driving each variable mechanism (VVT 50) such that the actual phase vt approaches the target phase vtt, that is, such that the valve timing of the intake valves 21 approaches the target valve timing (target value).

The valve operating characteristics controller of the preferred embodiment has the advantages described below.

(1) When the ECU 70 determines that at least one lock mechanism 90 of the two cylinder groups LS and RS is in a locked state, the target phase vtt of both VVT 50 is limited within a range from the lock phase to a predetermined limit value (predetermined phase d1). Accordingly, the difference between the actual phases vt of the VVTs 50 is restricted by controlling the VVTs 50 such that the actual phase vt approaches the restricted target phase vtt. In this way, the torque fluctuation in the internal combustion engine caused by the difference in valve timings is suppressed.

For example, there may be a case in which the two lock mechanisms 90 are both in the locked state, and thereafter one shifts to the unlocked state. In this case, in the preferred embodiment, the target phase vtt is set to a value less than the predetermined phase d1 before the shifting. Suppose, unlike the preferred embodiment, the ECU 70 is assumed to limit the actual phase vt when a specific lock mechanism 90 of the two lock mechanisms 90 is in the locked state. In this case, after the specific lock mechanism 90 shifts to the unlocked state, the ECU determines that the lock mechanism 90 is in the unlocked state, and thereafter limits the target phase vtt. Compared to this condition, in the preferred embodiment, the difference in the actual phases vt is quickly restricted without the processing delay which exists in the aforesaid determination process.

(2) The ECU 70 sets the target phase vtt to a predetermined phase d1 which is different from the lock phase in the process of Step S115. Accordingly, in the VVT 50 in the unlocked state, the actual phase vt is maintained at a target phase vtt which is different from the locked state. That is, in the VVT 50, the lock mechanism 90 is maintained in the unlocked state, and an unnecessary lock (erroneous lock) of the lock mechanism 90 is suppressed.

(3) When the target phase vtt calculated in step S100 is less than a predetermined phase d1, the ECU 70 keeps the target phase vtt unchanged. That is, when the target phase vtt calculated in step S100 is less than a predetermined phase d1, the ECU 70 does not increase the target phase vtt, that is, the target phase vtt is not deviated from the lock phase. Accordingly, fluctuation of the torque is suppressed without unnecessarily increasing the valve timing differential between the VVTs 50.

It should be apparent to those skilled in the art that the present invention may be embodied in many other specific forms without departing from the spirit or scope of the invention. Particularly, it should be understood that the present invention may be embodied in the following forms.

In the preferred embodiment, when the ECU 70 determines that at least one lock mechanism 90 of the two cylinder groups LS and RS is in the locked state and the target phase vtt calculated in step S100 is greater than a predetermined phase d1, the target phase vtt is replaced by the fixed predetermined phase d1. At this time, however, the ECU 70 may replace the target phase vtt with phases other than the predetermined phase d1 as long as the phase is within the previously described restricted range. Furthermore, the ECU 70 may replace the target phase vtt with a value which changes within the restricted range according to conditions. In the preferred embodiment, the ECU 70 must replace the target phase vtt with a value greater than a predetermined phase d2 in order to shift to the normal feedback control in step S140 in the flowchart of FIG. 5.

In the preferred embodiment, when the ECU 70 determines that at least one lock mechanism 90 of the two cylinder groups LS and RS is in the lock state, the target phase vtt of the two cylinder groups LS and RS are restricted to within the same range. The preferred embodiment is not limited to this arrangement. As long as the torque fluctuation can be suppressed, the ECU 70 may restrict the target phase vtt of the two cylinder groups LS and RS to a different range.

In the preferred embodiment, the ECU 70 determines whether or not the target phase vtt calculated in step S100 is less than a predetermined phase d1 (process of step S110). When the target phase vtt is less than the predetermined phase d1, the ECU 70 keeps the target phase vtt unchanged. However, the determination process of step S110 may be omitted. In this case, when it is determined that at least one lock mechanism 90 of the two cylinder groups LS and R is in the lock state, the ECU 70 replaces the target phase vtt with the predetermined phase d1 regardless of the size of the target phase vtt calculated in step S100.

When the ECU 70 determines that both lock mechanisms 90 of the two cylinder groups LS and RS are in the locked state, the target phase vtt need not be restricted. That is, the ECU 70 may also restrict the target phase vtt only when it is determined that the one lock mechanism 90 is in the lock state.

When the ECU 70 determines that only one lock mechanism 90 of the two cylinder groups LS and RS is in the lock state, the target phase vtt may also be restricted only for the other lock mechanism 90, that is, the lock mechanism 90 in the unlocked state.

In the preferred embodiment, the target phase vtt is restricted to a phase different from the lock phase by having the predetermined phase d1 differ from zero. Alternatively, the target phase vtt also may be set to the lock phase by setting the predetermined phase d1 to zero.

The ECU 70 may replace the holding duty ratio K periodically through a learning process so as to set a duty ratio dvt when the pressure differential between the pressure chambers 55 and 56 is actually zero. In this case, it is desirable that the predetermined duty ratios $\alpha$ and $\gamma$ be larger than the maximum error between the learned value of the holding duty ratio K and the duty ratio dvt when the pressure differential between the pressure chambers 55 and 56 is zero.

In the preferred embodiment, the reference values (predetermined speeds r1 and r2) for determining whether or not the duty ratio dvt to be changed are set in accordance with the oil temperature affecting the unlock. The preferred embodiment is not limited to this arrangement inasmuch as a single fixed value may be set beforehand as the determination reference values (predetermined speeds r1 and r2).

In the lock pin retraction control, the ECU 70 may reduce the duty ratio dvt from the upper limit value to the lower limit value in a predetermined range. In the preferred embodiment, the upper limit value may be more deviated from the holding duty ratio K than the lower limit value. Conversely, the lower limit value may be more deviated from the duty ratio dvt than the upper limit value.

In the preferred embodiment, when the duty ratio dvt setting process of steps S125 and S140 are not executed after the start of the processes of the flowchart on FIG. 5, the ECU 70 determines a predetermined duty ratio dvt which is less than "K−$\alpha$" in step S300. Alternatively, the ECU 70 may also determine a duty ratio dvt having a value "K−$\alpha$" in step S300. In this case, since the determination result is NO in step S300, the ECU 70 replaces the duty ratio dvt with "K−$\alpha$+A" in step S300.

In the VVT control by the ECU 70 (equivalent to the series of processes shown in the flowchart of FIG. 5), the process relating to abutment control (for example, steps S120, S125), or the process relating to lock pin retraction control (for example, steps S135, S145) may be omitted In the preferred embodiment, the lock pin 92 is moved by the hydraulic pressure of the pressure chambers 55 and 56. Alternatively, a hydraulic pressure path may be provided separately from the hydraulic pressure path for supplying hydraulic pressure to the two pressure chambers 55 and 56, and hydraulic pressure source separate from the oil pump 64 may be provided in this hydraulic pressure path, such that hydraulic pressure is provided to the lock pin 92 using this hydraulic pressure source. In this case, the lock mechanism 90 may be set to the unlocked state when the hydraulic pressure acting on the lock pin 92 exceeds a predetermined pressure. Alternatively, the lock mechanism 90 may be set to the unlocked state when the hydraulic pressure acting on the lock pin 92 is less than a predetermined pressure. The preferred embodiment is not limited to using hydraulic pressure inasmuch as, for example, an exclusive actuator such as an electromagnetic actuator or the like may move the lock pin 92.

In the preferred embodiment, the unlock pressure chamber 97, which communicates with the advance pressure chamber 55, has a greater hydraulic pressure acting surface area in the direction of disengaging of the lock pin 92 from the lock hole 96 than the unlock pressure chamber 94, which communicates with the delay pressure chamber 56. However, the acting surface area of the unlock pressure chamber 97 on the advance side may be less than that of the unlock pressure chamber 94 on the delay side.

In the preferred embodiment, the relative rotation of the vane hub 52 is locked by the engagement of the pin-shaped lock pin 92 and the lock hole 96. The preferred embodiment is not limited to this arrangement inasmuch as the relative rotation of the vane hub 52 may be locked by a non-pin-shaped member.

In the preferred embodiment, although the present invention is applied to a device provided with a lock mechanism 90 for locking the relative rotation of a vane hub 52 at the most delayed position, the invention is not limited to this arrangement. For example, the present invention may be applied to a device provided with a lock mechanism for locking the relative rotation at a position between the most delayed position and the most advanced position. In this case, a restricting means may restrict the target phase vtt on both the advance side and delay side of the lock position in a restricted range from the lock position to a predetermined value. Furthermore, the restriction may be for either the advance side or the delay side.

The present invention also may be provided on the exhaust side in a controller for changing the valve timing of exhaust valves, 31 and provided with a VVT on the exhaust camshafts 33 (33L, 33R). The present invention is not limited to controllers for changing only the valve timing of the exhaust valve 31 inasmuch as the invention may also be applied to both the intake side and exhaust side in controllers for changing valve timings for both the intake valve 21 and exhaust valve 31.

The internal combustion engine to which the present invention is applied is not limited to a V-type engine, and may be, for example, a horizontal opposed type engine. Furthermore, the present invention may be applied to engines in which a plurality of cylinders arrayed in series are grouped in a plurality of cylinder groups each having separate camshafts and VVT.

The number of cylinder groups is not limited to two, and may be, for example, three or more.

Rather than valve timing, for example, lift amount of an intake valve, lift amount of an exhaust valve, or amount of overlap between both valve operating periods may be used as the previously mentioned valve operating characteristics.

The present examples and embodiments are to be considered as illustrative and not restrictive, and the invention is not to be limited to the details given herein, but may be modified within the scope and equivalence of the appended claims.

What is claimed is:

1. A controller for controlling a valve operating characteristic of engine valves for a plurality of cylinder groups included in an internal combustion engine, the controller comprising:

a plurality of variable mechanisms, each provided for an associated one of the cylinder groups, for varying the valve operating characteristic of the associated cylinder group;

a plurality of lock mechanisms, each provided for an associated one of the variable mechanisms, for locking operation of the associated variable mechanism to maintain the valve operating characteristic of the associated cylinder group at a lock value;

a setting means for setting a target value for the valve operating characteristic based on an operating condition of the engine;

a drive means for driving each of the variable mechanisms so that the valve operating characteristic approaches the target value;

a determination means for determining whether the operation of the variable mechanism associated with each lock mechanism is locked; and a restriction means for restricting the target value for the valve operating characteristic of at least one of the variable mechanisms of which operation is unlocked when the operation of at least one of the variable mechanisms is locked so that difference between the target value and the lock value decreases.

2. The controller according to claim 1, wherein:

the internal combustion engine includes a plurality of camshafts, each driving the engine valves of an associated one of the cylinder groups;

the setting means sets a target rotational phase for each camshaft;

the variable mechanisms each change the target rotational phase of the associated camshaft to vary a valve timing of the engine valves; and the lock mechanisms each set the rotational phase of the associated camshaft to a lock phase corresponding to the lock value and lock the operation of the associated variable mechanism so that the rotational phase of the associated camshaft is maintained at the lock phase.

3. The controller according to claim 2, wherein the restriction means restricts the target rotational phase within a range from the lock phase to a predetermined restriction phase.

4. The controller according to claim 3, wherein the restriction means sets the target rotational phase at a phase differing from the lock phase when restricting the target rotational phase.

5. The controller according to claim 3, further comprising:

a prohibition means for prohibiting restriction of the target rotational phase with the restriction means when the target rotational phase does not exceed the predetermined restriction phase.

6. The controller according to claim 1, wherein the plurality of cylinder groups includes two cylinder groups arranged at a predetermined angular spacing in a V-shaped manner.

7. The controller according to claim 1, wherein the restriction means restricts the target value for the valve operating characteristic of all cylinder groups when the determination means determines that the operation is locked in all the variable mechanisms.

8. A controller for controlling valve timing of engine valves for a plurality of cylinder groups included in an internal combustion engine, the controller comprising:

a plurality of pulleys, each provided for an associated one of the cylinder groups;

a plurality of shafts, each attached to an associated one of the pulleys, for driving the associated engine valves;

a plurality of variable mechanisms, each provided for an associated one of the cylinder groups, for changing a relative rotation phase between the pulley and the shaft to vary the valve timing;

a plurality of lock mechanisms, each provided for an associated one of the variable mechanisms, for locking operation of the associated variable mechanism so that the relative rotational phase between the pulley and the shaft is maintained at a lock phase; and an electronic control unit for:

setting a target phase for the relative rotational phase between the pulley and the shaft based on the operation conduction of the internal combustion engine;

controlling each variable mechanism so that the relative rotational phase between the pulley and the shaft approaches the target phase;

determining whether operation of each variable mechanism associated with each lock mechanism is locked; and restricting the target value for at least one of the variable mechanisms of which operation is unlocked when the operation of at least one of the variable mechanisms is locked so that difference between the target value and the lock value decreases.

9. The controller according to claim 8, wherein the electronic control unit sets the target phase to a phase that is substantially equal to a first restriction phase when the operation of at least one of the variable mechanisms is locked and the difference between the target phase and the lock phase is greater than or equal to a first restriction phase.

10. The controller according to claim 9, wherein the electronic control unit determines whether operation of the variable mechanism is unlocked based on a relative rotation phase, between the pulley and the shaft, or an engine speed when the target phase is equal to or greater than a second restriction phase set at a phase that is smaller than the first restriction phase.

11. A method for controlling valve timing of engine valves in a plurality of cylinder groups included in an internal combustion engine, the method comprising:

setting a target value for the valve timing based on the operating condition of the internal combustion engine;

varying the valve timing so that the valve timing approaches the target value;

locking the valve timing at a lock value;

determining whether the valve timing is locked; and restricting the target value for the valve timing in at least one of the variable mechanisms of which valve timing is unlocked when the valve timing of at least one of the variable mechanisms is locked so that difference between the target value and the lock value decreases.

12. The method according to claim 11, wherein said restricting the target value includes setting the target value at a value that is substantially equal to a first restriction value when the difference between the target value and the lock value is greater than or equal to the first restriction value.

13. The method according to claim 12, further comprising:

determining whether the target value is set to a value between the lock value and a second restriction value, with the second restriction value being set to a value between the lock value and the first restriction value; and setting the target value to a value substantially equal to the lock value when the target value is set between the lock value and the second restriction value.

14. The method according to claim 12, wherein the internal combustion engine includes a plurality of pulleys, each provided for an associated one of the cylinder groups, and a plurality of shafts, each attached to an associated one of the pulleys, for driving the associated engine valves, the method further comprising:

determining whether the target value is set to a value between the first restriction value and the second restriction value, with the second restriction value set to a value between the lock value and the first restriction value; and determining whether the valve timing is locked based on a relative rotation phase, between the pulley and the shaft, or an engine speed when the target value is a value set between the first restriction value and the second restriction value.

* * * * *

UNITED STATES PATENT AND TRADEMARK OFFICE

CERTIFICATE OF CORRECTION

PATENT NO. : 7,100,554 B2
APPLICATION NO. : 10/984805
DATED : September 5, 2006
INVENTOR(S) : Hirowatari et al.

It is certified that error appears in the above-identified patent and that said Letters Patent is hereby corrected as shown below:

| Column | Line | |
|---|---|---|
| 5 | 17 | Change "SOR" to --50R--. |
| 14 | 43 | Change "K+y" to --K+γ--. |
| 17 | 1 | Before "In" start new paragraph. |

Signed and Sealed this

Second Day of January, 2007

JON W. DUDAS
*Director of the United States Patent and Trademark Office*